US006688029B1

(12) United States Patent
Dunn

(10) Patent No.: US 6,688,029 B1
(45) Date of Patent: Feb. 10, 2004

(54) METALLIC, MAGNETIC PICTURE FRAME

(76) Inventor: Patrick D Dunn, PMB 144, 637-B S. Broadway, Boulder, CO (US) 80305

( * ) Notice: Subject to any disclaimer, the term of this patent is extended or adjusted under 35 U.S.C. 154(b) by 0 days.

(21) Appl. No.: 10/174,609

(22) Filed: Jun. 19, 2002

(51) Int. Cl.[7] ..... A47G 1/06
(52) U.S. Cl. ..... 40/711; 40/799
(58) Field of Search ..... 40/711, 700, 798, 40/799, 600, 124.04

(56) References Cited

U.S. PATENT DOCUMENTS

| | | | | | |
|---|---|---|---|---|---|
| 3,245,165 | A | * | 4/1966 | Podoloff | 40/591 |
| 3,553,873 | A | | 1/1971 | Weston | 40/156 |
| 4,785,562 | A | * | 11/1988 | Good | 40/711 |
| 4,912,864 | A | * | 4/1990 | Price | 40/711 |
| 4,996,784 | A | * | 3/1991 | Hsu | 40/799 |
| 5,050,834 | A | | 9/1991 | Tardiff | 248/467 |
| 5,375,351 | A | * | 12/1994 | King et al. | 40/124.04 |
| 5,666,712 | A | | 9/1997 | Cvetkov | 29/458 |
| D411,975 | S | * | 7/1999 | Spencer | D12/193 |
| 6,010,338 | A | | 1/2000 | Watson | 434/81 |
| 6,189,250 | B1 | | 2/2001 | Bell | 40/711 |
| 2001/0025443 | A1 | * | 10/2001 | Martin | 40/711 |

* cited by examiner

*Primary Examiner*—Gary Hoge

(57) ABSTRACT

A frame (1) for displaying photos or other artwork on a steel refrigerator or other steel surfaces. The frame is made of steel and has a hole (2) laser cut in each side (FIG. 1). A magnet (3) is inserted in each hole to adhere the frame to the steel surface (FIG. 3). Each magnet overhangs slightly on top of the frame for added security. A steel magnet cover (4) is then placed on top of each magnet as a decorative touch (FIG. 5).

2 Claims, 8 Drawing Sheets

TOP VIEW

SIDE VIEW

SIDE VIEW

TOP VIEW

METALLIC, MAGNETIC PICTURE FRAME

FEDERALLY SPONSORED RESEARCH

Not Applicable

SEQUENCE LISTING OR PROGRAM

Not Applicable

BACKGROUND

1. Field of Invention

This invention relates to ferrous picture frames, where magnets are used to secure them to metal objects such as refrigerators or filing cabinets. The invention presents an alternative construction combined with a unique artistic value.

2. Description of Prior Art

One known magnetic attachment device comprises a circular disc having a diameter of about two inches. The front (exposed) face of the disc has a picture thereon, e.g. a flower; the rear of the disc is a thin permanent magnet. Disc thickness is about one eighth inch. In use, the disc is placed over a piece of paper held against the surface of the family refrigerator; magnetic attractive force holds the disc and paper sheet on the steel refrigerator surface.

A disadvantage of the known arrangement is the fact that the disc partially hides the paper and some of the information thereon. Another disadvantage is that the magnetic force due to a single magnetic disc may be insufficient to support a large sheet of paper, especially if the paper is slippery or heavy (thick). Also, the magnetic disc is not especially useful for photographs or greeting cards that are heavier than paper. Additionally, any irregular edges on the sheet (due to tearing or choppy scissors cuts) are visible and give a cluttered disorderly appearance. Another known magnetic attachment device comprises magnetic sheet material cut into picture frame shapes. The exposed side of the magnetic surface has been coated with colors or designs to make it more aesthetically pleasing. However, the fragility of this material could lead to easy tearing. Still another known frame with magnetic components for use on refrigerators and other metal objects uses plastic hollow tubing. Magnets are affixed to the inside of the tubing in order to secure the frame and photo to the metal object. Again, this material is fragile and breakable if dropped.

My invention takes the process one step further by using steel or other ferrous material in the construction of the frame. This adds weight to the frame making it more solid and substantial than previous designs. Additionally, the magnet application is unique in that the magnets fit through holes in the frame. Steel magnet covers are put on the magnets to provide an added artistic appeal.

OBJECTS AND ADVANTAGES

Accordingly, several objects and advantages of my invention are:

(a) to provide a frame that does not hide the item that is to be framed;
(b) to provide sufficient magnetic force as to be able to hold heavier weight and slippery paper;
(c) to provide a frame where irregular edges do not show;
(d) to provide a frame that is more durable than previous art;
(e) to provide a frame that gives an appearance of high quality;

(f) to provide a frame that the consumer can customize to their liking;
(g) to provide a frame with a high degree of novelty.

The frame will satisfy existing needs and is compatible with existing patterns of use. Further objects and advantages will become apparent from a consideration of the ensuing description and drawings.

SUMMARY

In accordance with the present invention, a metallic, magnetic photo frame comprises a metal picture frame, magnets and artistic magnet covers.

DRAWINGS

Drawing Figures

In the drawings, related figures have the same number.

Figure 3:
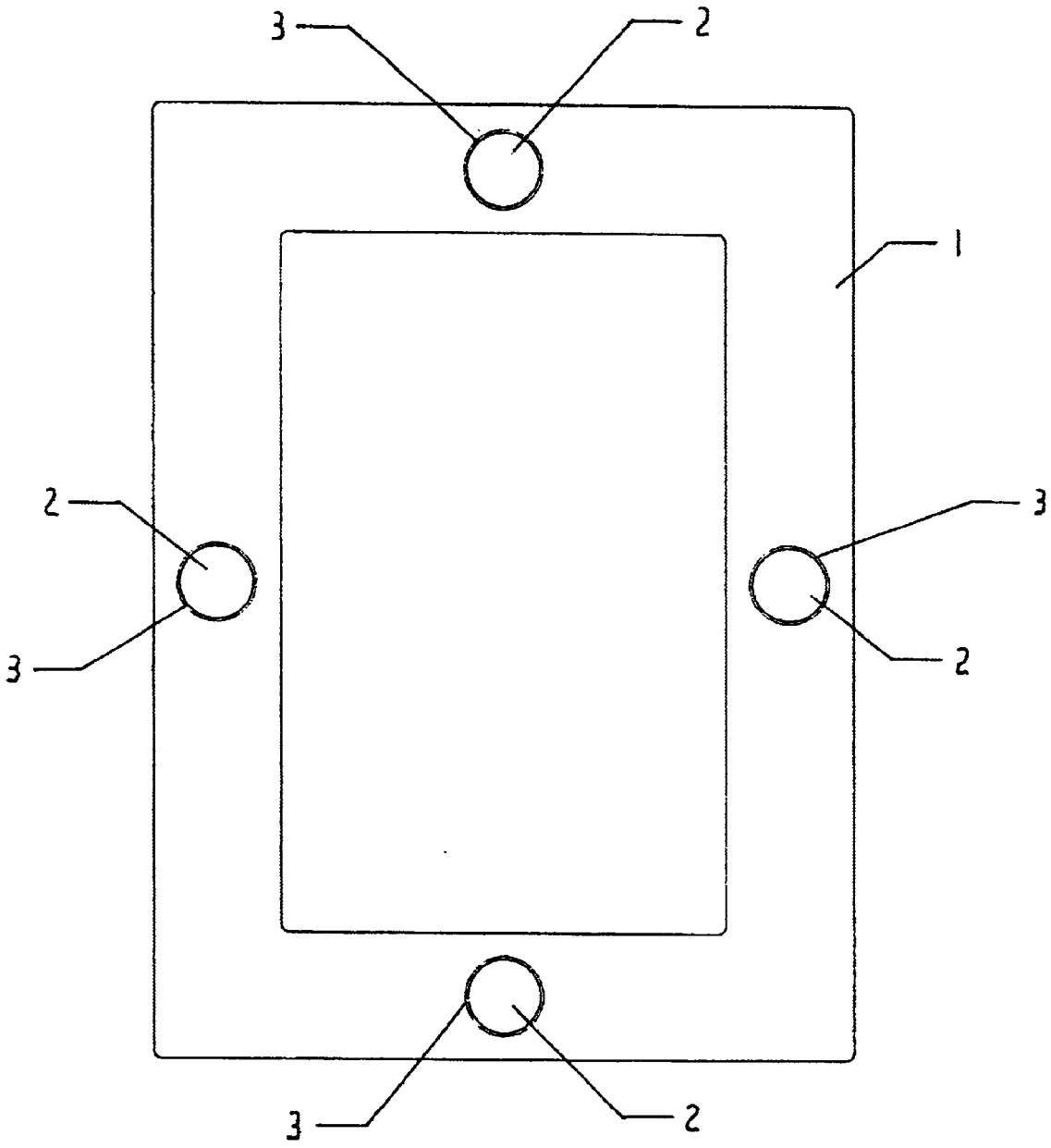
FIG. 3 shows a top view of the frame with a magnet inserted in each hole.
Figure 3A:
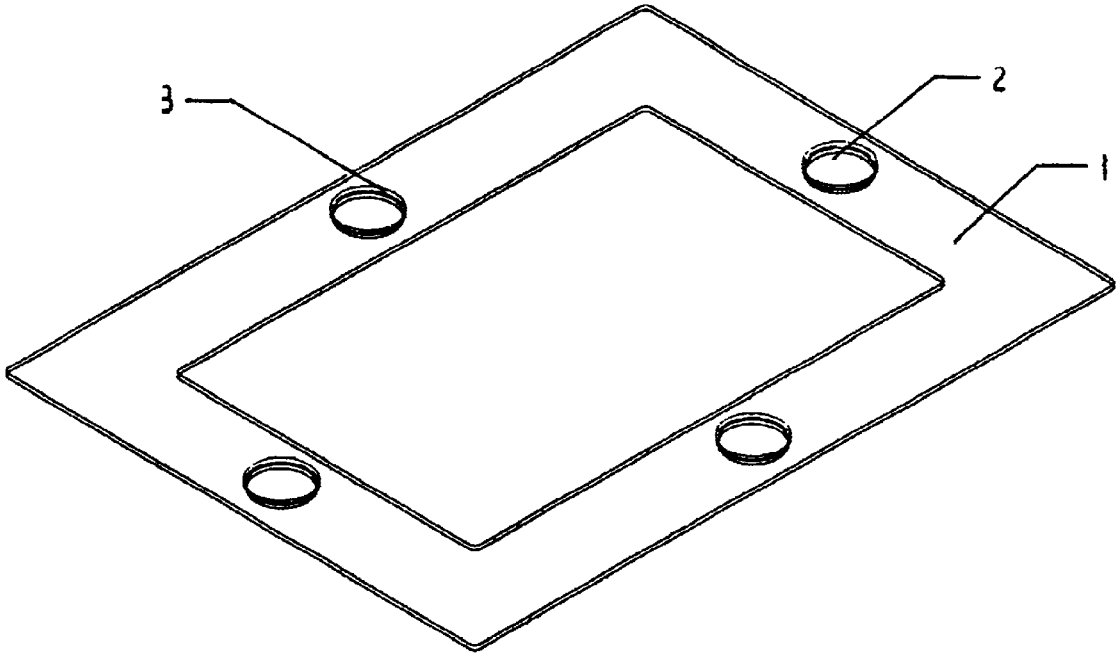

FIG. 3*a* shows a perspective view of the frame with a magnet inserted in each hole.

Figure 4:
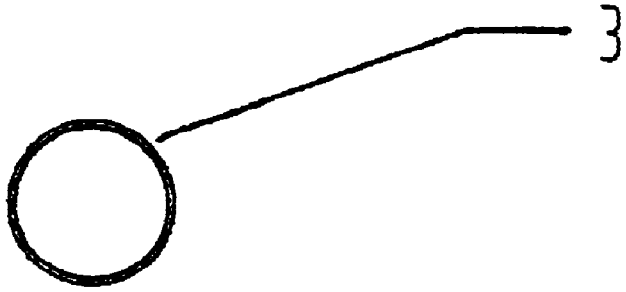
Figure 4:
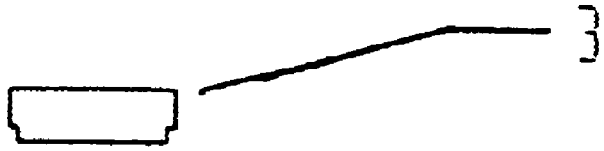

FIG. 4 shows a top view and a side view of a magnet.

Figure 5:
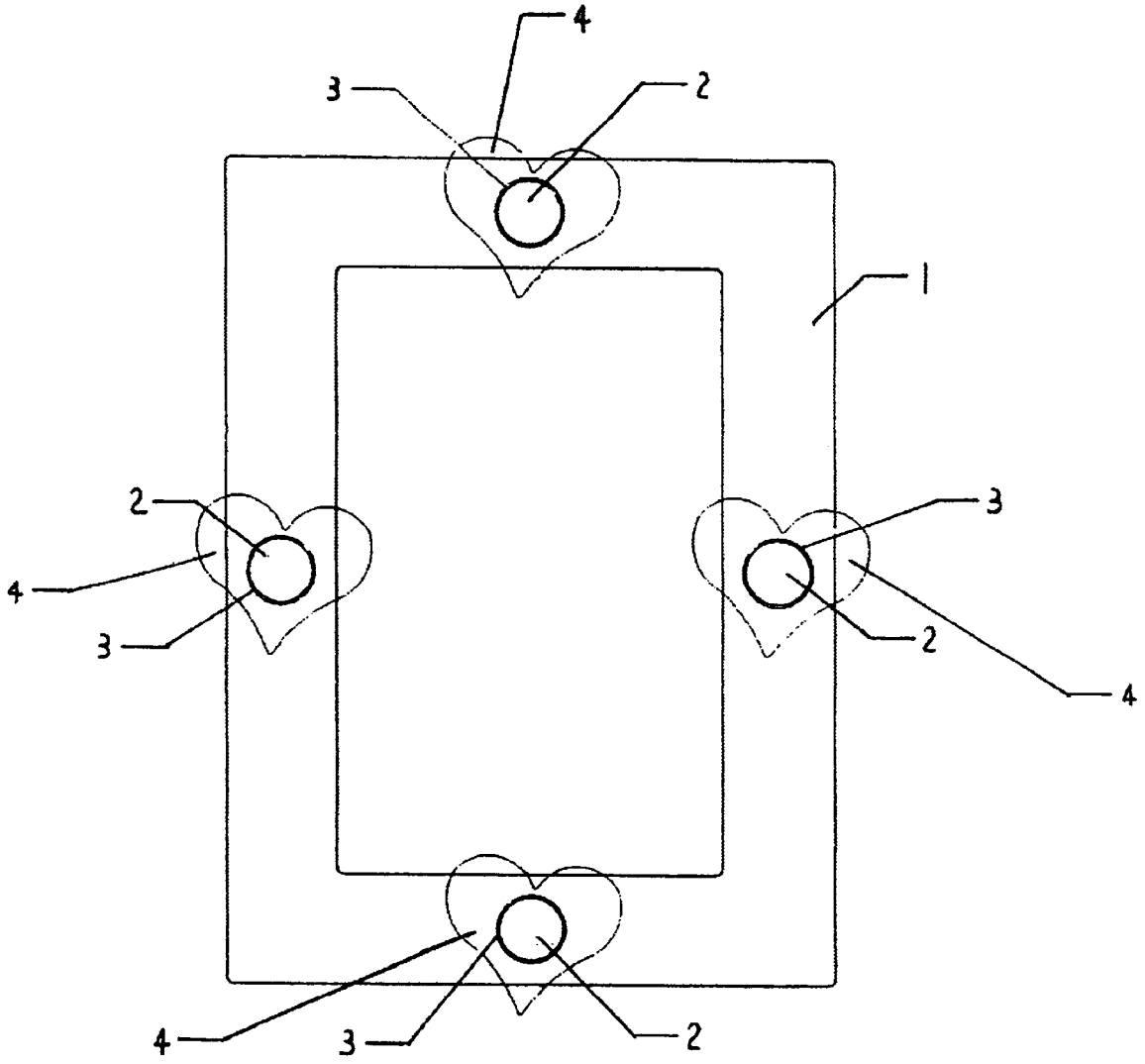

FIG. 5 shows a top view of the frame with the magnet inserted in each hole and a magnet cover on top of each magnet.

Figure 5A:
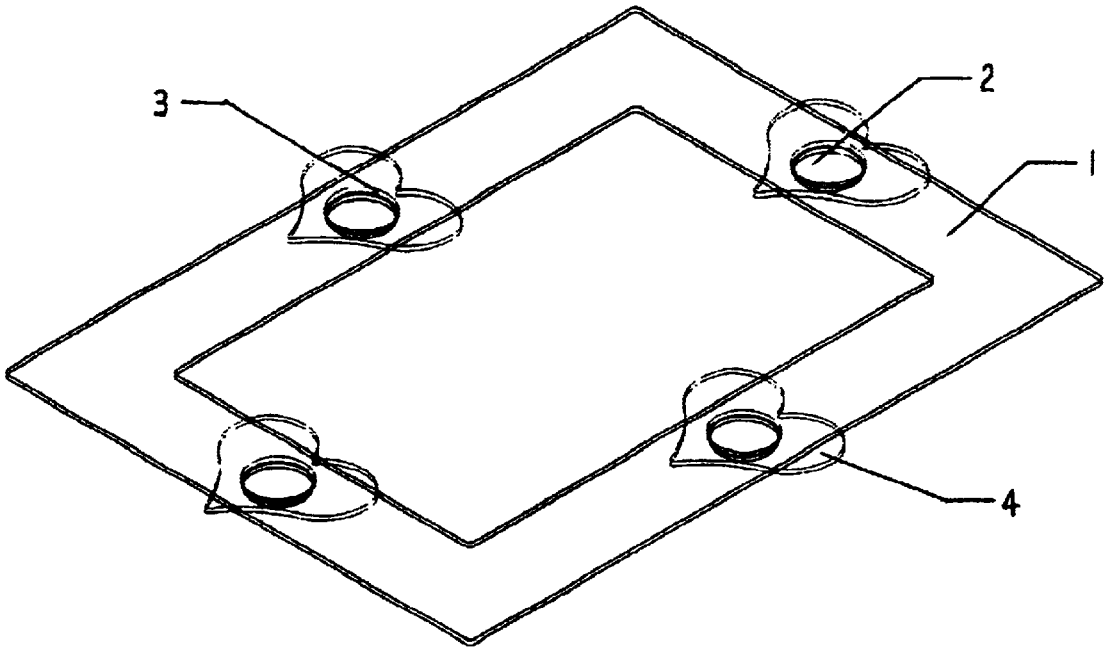

FIG. 5*a* shows a perspective view of the frame with the magnet inserted in each hole and the magnet cover on top of each magnet.

Figure 6:
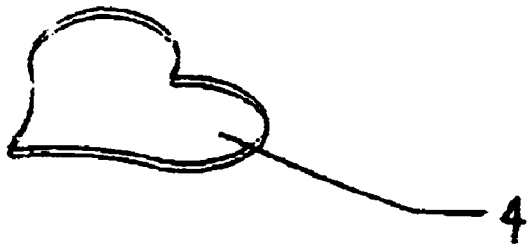
Figure 6:
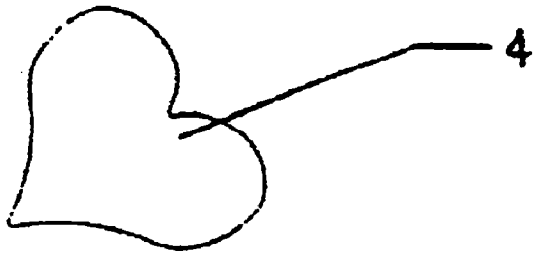

FIG. 6 shows a top view and a side view of a magnet cover.

REFERENCE NUMERALS IN DRAWINGS

1 frame
2 hole
3 magnet
4 magnet cover

DETAILED DESCRIPTION

Description—FIG. 1 thru 6—Preferred Embodiment

Figure 1:
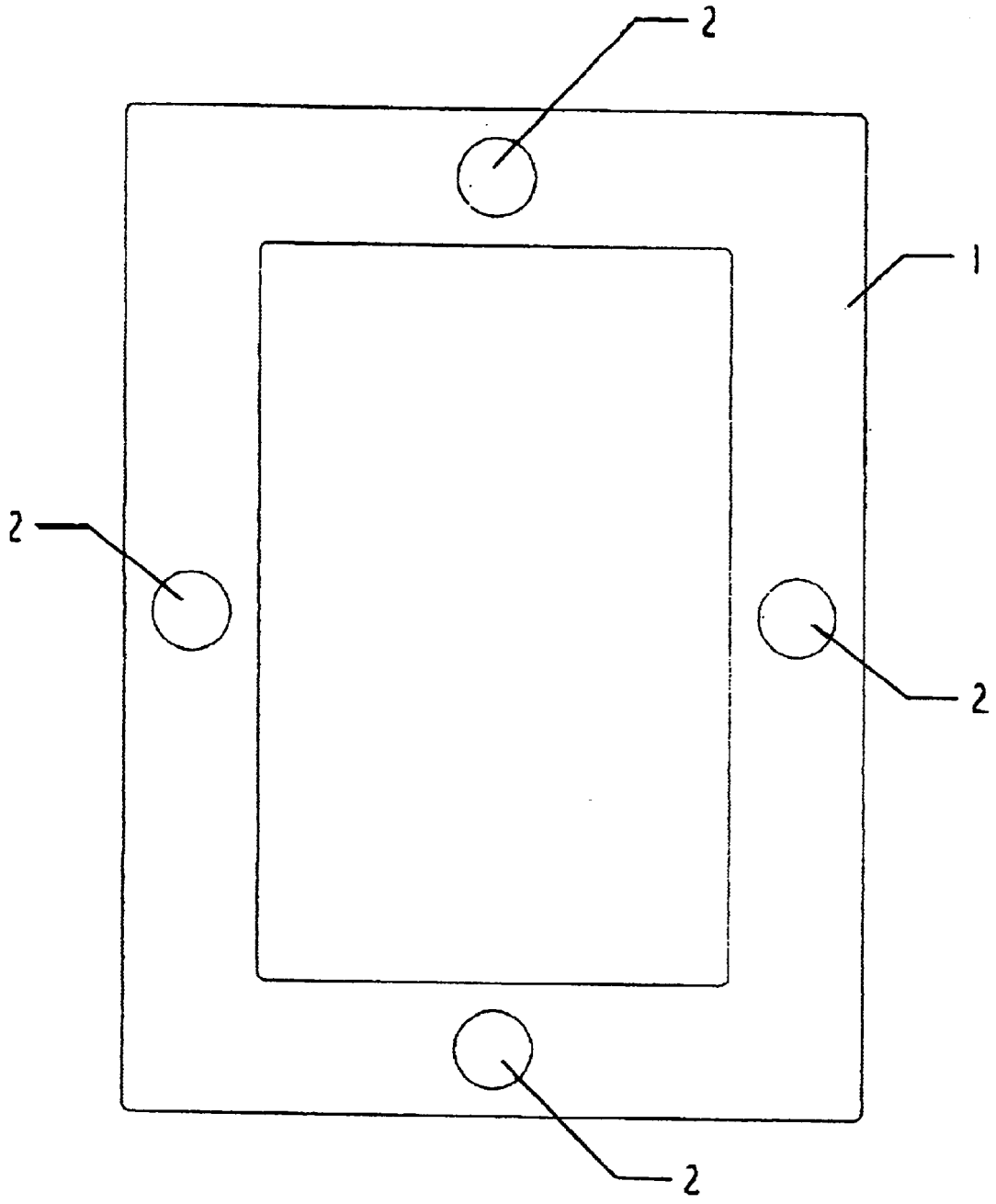
FIG. 1 shows a top view of a frame with holes in each side.
Figure 2:
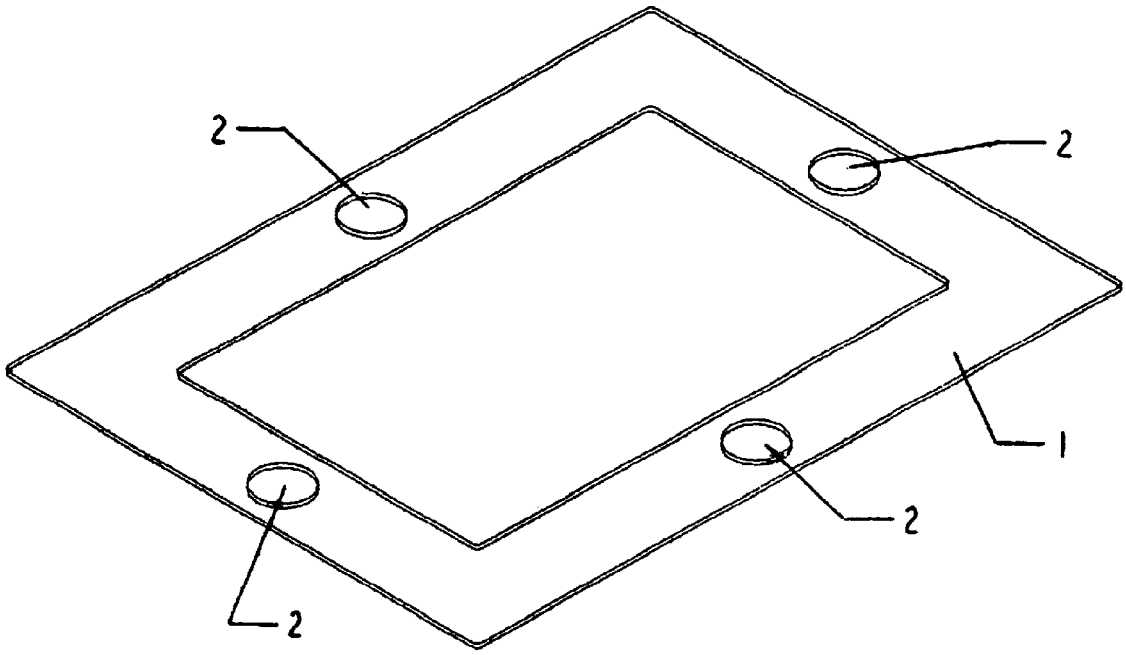
FIG. 2 shows a perspective view of the same frame.

A preferred embodiment of the frame of the present invention is illustrated in FIG. 1 (top view) and FIG. 2 (perspective view). The frame (1) will be laser cut (or stamped) out of cold-rolled steel into rectangular shapes (as shown) or other geometric or custom designs. Each frame will have a hole (2) in each side of the frame where a magnet will be inserted. The frame can be made out of other metallic material such as a 400 series stainless steel.

FIGS. 3 and 3*a* show the frame (1) with a magnet (3) inserted in each hole (2). The holes and the magnets are circular in nature and designed so that the magnet fits snugly into the hole. The magnet will then overlap onto the frame slightly for additional support. Other shapes and sizes may be utilized to yield the same result. The magnet is 0.200 thick so as to add an extra dimension to the frame assembly. FIG. 4 shows a top and side view of how the magnet is shaped. The magnet is a ceramic 5 magnet. This provides the strength needed to securely hold the frame to the metallic surface. Other magnetic materials could be considered with frames of different designs and shapes.

FIGS. 5 and 5*a* show the frame (1) with a magnet (3) inserted into each hole (2), and with a magnet cover (4) on top of each magnet. This particular magnet cover is in the shape of a heart. Any shape, design, logo, character, number or letter may be used as a magnet cover. The magnet cover is laser cut from the same material (cold-rolled steel) as the frame. However, any other magnetic material may be used and other cutting processes could be used to yield the same result. FIG. 6 shows a top view and a side view of the magnet cover.

ADVANTAGES

From the description above, a number of advantages of my metallic, magnetic picture frame become evident:

(a) A laser cut picture frame will neatly frame the intended picture or piece of art.

(b) The magnets will provide sufficient force to hold photos and heavier weight paper to the metallic surface.

(c) The raw material (cold-rolled steel) used in the production of this frame will provide a very durable product.

(d) The essence of the raw material provides a distinction of higher quality. Powder coating the surface adds further distinctive qualities.

(e) Consumers can customize the frame to their liking buy purchasing different magnet covers and different colors. Almost any design can be replicated. This adds to the novelty of the frame.

Operation—FIGS. 1–6

The manner of using the metallic, magnetic picture frame is slightly different than frames that are currently in use. One must first set the frame on a flat surface. The user then inserts a magnet into each hole. The frame, with magnets inserted, is then placed on the metallic surface and over the item to be framed. The magnet covers are then put on top of each magnet. The magnet covers can then be changed to the consumers liking without the need of removing the frame from the surface.

CONCLUSION, RAMIFICATIONS, AND SCOPE

Accordingly, the reader will see that the metallic, magnetic picture frame can be used to frame a photo in an easy and stylish manner. The frame is durable and can be customized by the consumer to fit his or her likings. Furthermore, the metallic, magnetic picture frame has additional advantages in that

- it provides a frame that does not hide the item that is to be framed;
- it provides sufficient magnetic force as to be able to hold heavier weight and slippery paper;
- it provides a frame where irregular edges do not show;
- it provides a frame that is more durable than previous art;
- it provides a frame that gives an appearance of high quality;
- it provides a frame that the consumer can customize to their liking;
- it provides a frame with a high degree of novelty.

Although the description above contains many specificities, these should not be construed as limiting the scope of the invention but as merely providing illustrations of some of the presently preferred embodiments of this invention. For example, the frame can have other geometric shapes and/or countless custom designs. The magnet covers can also take on many shapes, sizes, colors or custom designs. Etching or stamping can be added to either the frame or the magnet cover.

I claim:

1. A display device for displaying photos or artwork on an outer surface of a refrigerator or other steel surface comprising:

- a frame having a plurality of sides, said frame being composed of cold-rolled steel or other metallic magnetic material;
- each side of said frame having one hole cut through the frame;
- each hole having a similarly shaped magnet inserted into said hole.

2. The frame of claim 1 wherein each magnet has a magnet cover placed thereon, said magnet cover being composed of a magnetic material.

* * * * *